US006623095B1

(12) United States Patent
Ward et al.

(10) Patent No.: US 6,623,095 B1
(45) Date of Patent: Sep. 23, 2003

(54) PRINT-QUALITY CONTROL METHOD AND SYSTEM

(75) Inventors: Jefferson P. Ward, Brush Prairie, WA (US); Steven B. Elgee, Portland, OR (US); William J. Allen, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 08/691,060

(22) Filed: Aug. 1, 1996

(51) Int. Cl.[7] ..... B41J 29/393; B41J 29/38; B41J 2/165

(52) U.S. Cl. ..... 347/19; 347/19; 347/14; 347/23

(58) Field of Search ..... 347/19, 7, 22, 347/15, 13, 14; 346/1.1, 140; 358/296

(56) References Cited

U.S. PATENT DOCUMENTS

| | | | | |
|---|---|---|---|---|
| 4,977,459 A | * | 12/1990 | Ebinuma et al. | 358/296 |
| 5,038,208 A | * | 8/1991 | Ichikawa et al. | 347/19 |
| 5,124,720 A | * | 6/1992 | Schantz | 347/19 |
| 5,285,220 A | * | 2/1994 | Suzuki et al. | 347/19 |
| 5,296,873 A | | 3/1994 | Russell et al. | 346/28 |
| 5,297,017 A | * | 3/1994 | Haselby et al. | 347/19 |
| 5,477,246 A | | 12/1995 | Hirabayashi et al. | 347/12 |

FOREIGN PATENT DOCUMENTS

| | | | | |
|---|---|---|---|---|
| EP | 452157 A | | 4/1994 | |
| EP | 0747224 A1 | | 5/1996 | |
| JP | 360104338 | * | 6/1985 | 347/47 |

OTHER PUBLICATIONS

Hewlett–Packard Patent Application S/N 08/235,769; Filed Apr. 29, 1994.

* cited by examiner

*Primary Examiner*—Hai Pham
*Assistant Examiner*—Charles W. Stewart, Jr.

(57) ABSTRACT

Overall print quality is improved via a method whereby an actual image is printed, a virtual image is defined based on image data, and the actual and virtual images are compared to identify a printhead error pattern which may be used to correct subsequent printing errors. This typically is accomplished via a system which employs an optical device which views an actual image to produce optical data, and a controller which derives a virtual image from image data provided to the printhead. The controller then compares the actual and virtual images to identify an error pattern, and modifies subsequent image data to compensate for perceived errors.

2 Claims, 5 Drawing Sheets

PRINT-QUALITY CONTROL METHOD AND SYSTEM

TECHNICAL FIELD

The present invention relates generally to ink-jet printers and, more particularly, to a method of detecting poor print quality automatically and taking corrective actions to compensate for such poor print quality. This method is implemented via a print-quality control system which employs optical feedback to read a recently printed image, compares such printed image to a virtual image, and takes corrective action to improve the print quality of subsequently printed images.

BACKGROUND ART

Ink-jet printing mechanisms print images on a print medium by firing drops of ink from one or more pens while the pen moves back and forth across the print medium. An ink-jet printer is a device using such ink-jet printing mechanisms. Examples of ink-jet printers include plotters, facsimile machines, and typical computer-attached printers. The print medium on which a printer prints may be any sheet material such as paper, MYLAR™, foils, transparencies, card stock, etc.

Ink-jet printers print dots by ejecting very small drops of ink onto the print medium. The printers typically include a movable carriage that supports one or more pens, each having a printhead with plural ink-ejecting nozzles. The carriage traverses the surface of the print medium, and the nozzles are directed to eject drops of ink at appropriate times pursuant to commands of a microcomputer or other controller. The timing of the application of the ink drops is intended to correspond to the pattern of pixels of the image being printed.

Color ink-jet printers commonly employ a plurality of printheads which may be mounted on the carriage to produce different colors. Each printhead is connected to one or more reservoirs which contain ink for delivery to the printhead's nozzles. Typically, the reservoirs contain base colors such as cyan, magenta, yellow, and black. Depositing a drop of a base color ink produces a base-colored dot, while depositing multiple drops of different base color inks forms secondary or shaded colors. In other words. the base colors can be combined to form secondary or shaded colors.

Print quality is one of the most important considerations in the use of an ink-jet printer. Although the quality of an image generally is subjective, specific aspects of a printed image can be objectively identified as being indicative of poor print quality. For example, misaligned dots, missing dots, misshapen dots, small dots, large dots, and incorrectly colored dots all are objectively identifiable print errors. Those who are skilled in the art will understand and appreciate that a printed image is of poor print quality if the image exhibits one or more of the above-identified print errors. These errors typically arise from variations or tolerances in the various printing mechanisms or in the printer itself. In addition, various characteristics of the print media may affect print quality. Moreover, environmental conditions, such as temperature and humidity, may affect print quality.

Existing automatic techniques and systems for controlling print quality generally are based upon an estimate of how a specific action may affect print quality. These estimates lack verification of whether corrective action is actually necessary. Also, there is no reliable indication of the extent to which action should be taken to improve print quality.

Further, known techniques for controlling print quality do not consider how a printed image actually looks, a factor which should be considered when addressing print quality.

DISCLOSURE OF THE INVENTION

The present invention overcomes the drawbacks and problems of existing print-quality control techniques and systems using an optical system preferably attached to a printhead of an ink-jet printer. The actual printed image thus may be viewed and analyzed and, if it is determined that one or more dots represent poor print quality corrective action may be taken to compensate for the problem so that subsequently-printed dots do not exhibit such poor print quality characteristics.

In one embodiment of the invention, a print-quality control method is employed for use in connection with a printer having a printhead configured to print based on image data. The method includes defining a virtual image derived from the image data, printing an actual image based on the image data, comparing the actual image to the virtual image to identify a printhead error pattern, and modifying subsequent image data to compensate for the identified printhead error pattern.

The invented method may be used in connection with an ink-jet printer which includes a printhead having plural nozzles. The printhead typically receives image signals directing it to print an image, such image being deposited on a print medium by firing the printhead's nozzles according to the received image signals. The printed image thus will include individual dots printed by the nozzles and may include dots representative of poor print quality due to less-than-optimal operation of the printing mechanisms and/or due to the print medium on which printing occurs.

After printing the image, dots are read by an optical device which preferably is attached to the carriage of the printhead. The optical device produces optical data based on the dots of the printed image and a controller determines whether the printed image includes a poor-print-quality (PPQ) set of dots. If the image does include a PPQ set, then the controller identifies the nozzles which actually printed the PPQ set of dots. Corrective action then may be taken to ameliorate or eliminate the poor-print-quality characteristics of subsequently-printed dots by compensating for the poor print quality of the dots printed by the identified nozzles.

An objective of the present invention is to provide an automatic print-quality control method and system for use in an ink-jet printer where poor print quality will be corrected without the need for user intervention or notification. Another objective is to correct for various types of poor print quality by viewing actually printed dots with an optical device and correcting for observable objective print quality problems.

These and other objects and advantages of the present invention will be more readily understood after a consideration of the drawings and the detailed description of the preferred embodiment which follows.

DETAILED DESCRIPTION OF THE PREFERRED EMBODIMENTS AND BEST MODE FOR CARRYING OUT THE INVENTION

Figure 1:
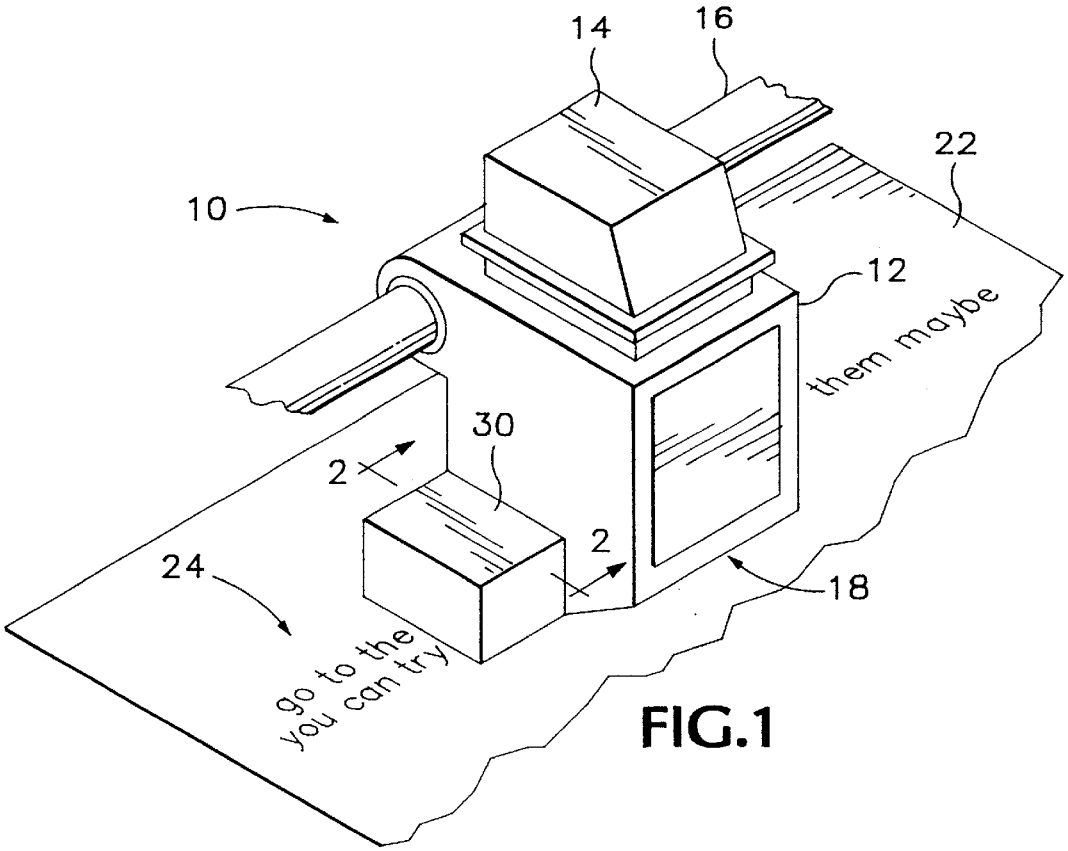
FIG. 1 is a fragmentary isometric view of an ink-jet printing system and an optical device constructed according to a preferred embodiment of the present invention.

Referring initially to FIG. 1, the printing mechanism of a somewhat typical inkjet printer is shown at 10, such printer employing a printing system constructed in accordance with the present invention. As indicated, the printing system employs various printing mechanisms, including a carriage 12, an ink reservoir 14, a rod 16, and a printhead 18. Those skilled will appreciate that the printing system may be used either with a monochrome or multi-color printer, and thus may be used with either a single printhead or plural printheads. For simplicity, the system is described herein as employing only a single printhead.

As is conventional, carriage 12 reciprocates back and forth on rod 16 across print medium 22. Ink reservoir 14 typically is mounted for reciprocation with carriage 12, but may be stationary and connected to the printhead via ink-conducting tubes. The printhead includes a plurality of active (operating) nozzles, which are configured to deposit ink on the print medium as the printhead passes thereacross. The printhead also typically includes interspersed redundant nozzles to replace the function of failed active nozzles. These redundant nozzles remain dormant until activated to replace a failed active nozzle.

In FIG. 1, printhead 18 is shown printing an image onto a portion of print medium 22. Such image (referred to herein as an actual image) includes a plurality of dots which are deposited on the print medium by printhead 16. Print medium 22 typically is paper and may be referred to herein as "the paper" or "a page." The dots are deposited in a print zone 24 which is defined in the area directly below the printhead during the carriage's reciprocating motion.

Although the printing system does print images, it does not do so without instructions. The printing system thus is provided with image data in the form of signals which direct the printhead to fire selected nozzles, and thereby to deposit ink dots in predetermined fashion. These signals also may provide instructions to various subsystems of the printing system (e.g., printhead servicing). Therefore, each action taken by the printing system ultimately is associated with image data including one or more signals.

The printing system also includes media feed motors (not shown) which feed a page through print zone 24 so that an image may be printed thereon, and a service station (not shown) which is configured to service (e.g., clean) the printhead. A printhead periodically will park at the service station so that viscous plugs of ink may be cleared from the nozzles. Such servicing typically is directed at predetermined intervals, but may be directed upon identifying an error which may be corrected by servicing the printhead.

Referring still to FIG. 1, it will be noted that the depicted printing system includes an optical device 30 which is attached to carriage 12 and positioned over print zone 24 to view images printed on the print medium. A cross-section of the optical device is shown in FIG. 2, providing the reader with an understanding of the manner in which actual images typically are viewed.

Figure 2:
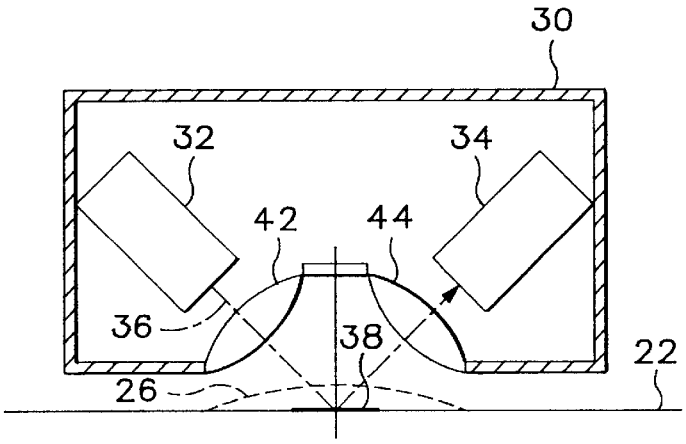
FIG. 2 is a cross-sectional view of the optical device taken along line 2—2 of FIG. 1.

As indicated in FIG. 2, the optical device includes an emitter 32 for emitting optical electromagnetic waves through a lens 42 onto print medium 22 for detection by a detector 34 (positioned behind a lens 44). The emitter and detector preferably use the visual optical spectrum and are of a type known to those skilled in the art. Arrow 36 shows the path of a light ray emitted by emitter 32. Lens 42 adjusts to focus the light ray onto print medium 22. The ray is reflected off the print medium through lens 44, which is adjusted to focus the light ray onto detector 34. The optical device is configured to view dots (such as dot 38) on the print medium by scanning them as the carriage moves across the print zone. The optical device may include one or more emitter/detector pairs, each calibrated to detect a specific color of ink. The angle between the emitter and the detector shown in FIG. 2 is approximately 90°. However, it is preferable to have a lesser or greater angle between them to reduce the effect of glare.

In accordance with the present invention, optical device 30 has the ability to measure the dimensions, location and color of individual dots on the print medium, and is configured to measure how much cockling occurs. This information is used to identify dots of poor print quality, and to identify other error patterns which are correctable by adaptation of printer firmware. Focusing first on the difficulties encountered due to cockling, it is noted that the cockled portion of the print medium is shown by dotted line 26 in FIG. 2. It also is noted that ink used in wet ink-type printing includes a relatively large amount of water. As the wet ink contacts a print medium, the water in the ink saturates the fibers of the print medium, causing the fibers to expand. This, in turn, causes the print medium to buckle. Buckling, also called cockling, causes the print medium either to bend downwardly uncontrollably away from the printhead, or to bend upwardly toward the printhead uncontrollably. Short of the medium reaching its saturation level, the bending or curving of the medium increases as the print density increases. Because a platen is positioned directly below the print medium under the print zone, a portion of the print medium buckles or curves upwardly instead of downwardly away from the printhead. This upward buckling increases the possibility of the print material contacting the printhead, thereby smearing the freshly printed ink on the print material.

To achieve good print quality, pen-to-print medium spacing of less than 1.5 millimeters (mm), and preferably less than 1.0 mm, typically is required. However, bending amplitudes of the print medium in certain pen/ink combinations can be greater than 3 mm. To reduce this problem of paper buckling, printers have employed high-powered beaters to dry moisture. However, incorporating a heater into a printer adds to the complexity and to the cost of the printer mechanism. Heaters also create fire safety and burn safety problems. Additionally, incorporation of a heater in a printer increases the throughput because less time is required to dry moisture from the print material. Incorporation of heaters also causes print image distortion problems because the print medium unevenly shrinks during drying.

Optical device 30 can measure how much cockling has occurred by measuring the extent to which it is necessary to refocus lens 42 and/or lens 44 to view a cockled portion 26 of print medium 22. Based on these measurements, the printer can use less ink to avoid cockling and may be able dynamically to adjust the elevation of the printhead above print medium 22 so that it is as close as possible without actually touching the print medium.

Figure 3:
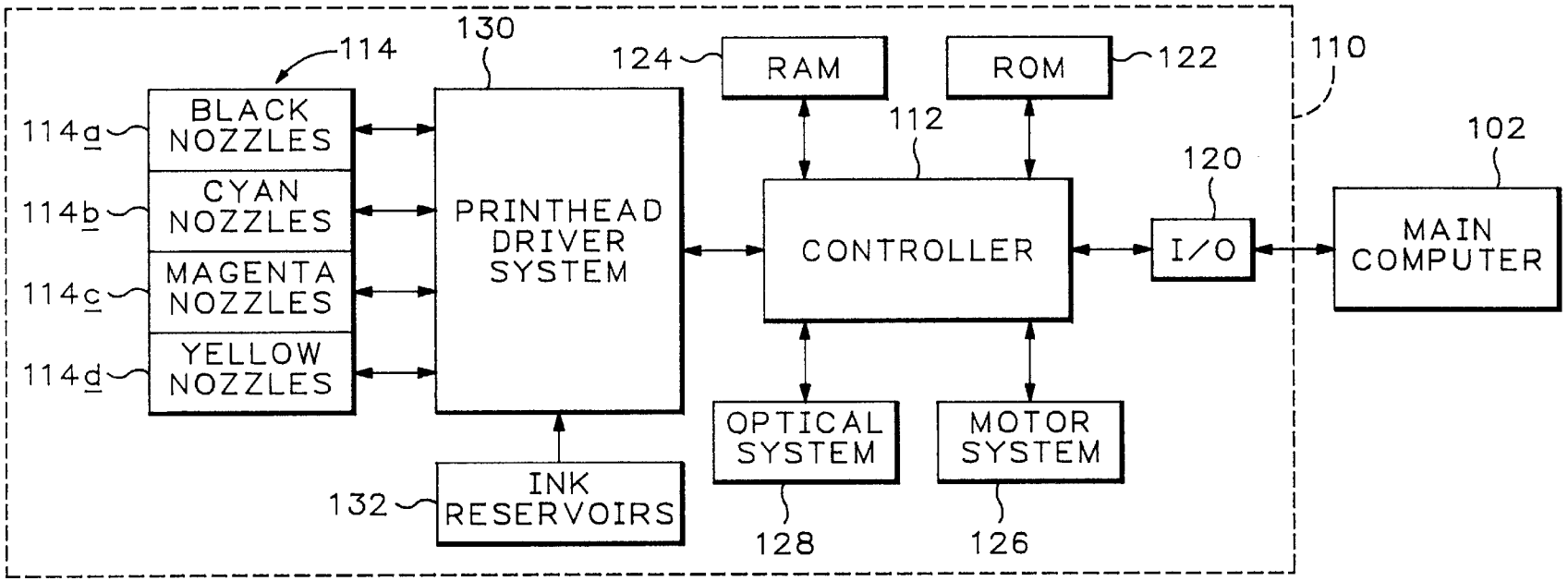
FIG. 3 is a schematic diagram of a print-quality control system constructed according to a preferred embodiment of the present invention.

FIG. 3 is a schematic block diagram showing, at 110, a preferred embodiment of the invented print-quality control system. The system includes a controller 112 which is operatively connected to an external main computer 102 via a conventional input/output (I/O) connection 120. In the preferred embodiment controller 112 is a microprocessor connected to a read-write memory (RAM) 124 and a read-only memory (ROM) 122. In addition, other types of electronic or mechanical memories may be connected to the controller. For example, a pen may have ROM, dip-switches, hardwired circuitry, or other memory mechanisms for identifying characteristics of that pen. The pen provides its stored characteristics to the controller once it is connected to the printer. The microprocessor is connected to the main computer, which provides information on what to print. Alternatively, the printer may have a much less sophisticated microprocessor which merely acts as a communications conduit from main computer 102 to the printing system. Under this alternative embodiment, main computer 102 acts as the controller.

The printing system includes all printing mechanisms involved in the printing of images. Specifically, the printing system includes a motor system 126, a printhead driver system 130, one or more ink reservoirs 132, and one or more pens such as pen 114. The motor system includes a feed motor which advances paper through the print zone, and a reciprocating carriage motor which moves the carriage back and forth on the rod. Printhead driver system 30 controls the actual firing of the nozzles of pen 114. Pen 114 includes a printhead with nozzles 114*a* connected to an ink reservoir containing black ink (i.e., black nozzles), a printhead with cyan nozzles 114*b*, a printhead with magenta nozzles 114*c*, and a printhead with yellow nozzles 114*d*. An optical system 128 is attached to the controller, the optical system including optical device 30, as depicted in FIGS. 1 and 2.

Print quality is one of the most important considerations in the design and development of an ink-jet printer. Determining the quality of a printed image typically is subjective. However, specific aspects of a printed image can be objectively identified as suggesting poor print quality. The following are examples of problems which may be objectively identified: misaligned dots, misshapen dots, missing dots, small dots large dots, and incorrectly colored dots. The causes of these problems lie in the printing characteristics of various printing mechanisms or of the print media. Poor print quality also may be caused by problems arising in the production, manufacture or assembly of the various parts of the printer mechanisms. The following are examples of the causes of printer-mechanism-produced problems: pen-to-pen alignment, orientation of a pen, inconsistent carriage velocity, scan axis directionality (SAD), nozzle aim, and nozzle drop ejection speed and accuracy. Any of these problems may produce misaligned dots.

In a printer having multiple replaceable pens, the nozzles of each pen may be misaligned compared with the nozzles of the other pens. Furthermore, the misalignment of a pen may be caused by any spatial orientation allowed by the pen-attachment tolerances of a printhead. If a pen is twisted or rotated relative to the other pens, it is understood to have a different orientation than the other pens. Another mechanism that may introduce characteristics of poor print quality is the carriage motor that moves the carriage back and forth over the print medium. Any sudden acceleration or deceleration of the carriage may cause the dots being printed at that moment to be misaligned. In other words, the drops of ink fired from the nozzles of the printhead have an inconsistent velocity. This inconsistent velocity of the drops is due to inconsistent carriage velocity. In addition, in an ideal world each nozzle of each printhead would be perfectly vertical and fire with a uniform drop ejection speed. In other words, the scan axis directionality (SAD) of all of the nozzles would be uniform. However, in reality, the aim and accuracy of the nozzles are not uniform. The speed at which they fire drops also is not uniform. These non-uniform mechanisms and operations produce misaligned dots.

To correct the misalignment so that subsequent dots will be aligned, the image signals which produced the misaligned dots should be modified so that the identified nozzles fire an instant earlier or later relative to the timing of when the misaligned dot was printed. The invented system thus employs a mechanism for identifying the nozzle or nozzles which print misaligned dots. Once the nozzle which printed the misaligned dot is identified, image signals or data associated with that nozzle may be modified so that any subsequent dot printed by that nozzle is properly aligned.

A poor print quality set of dots of an actual image also may be characterized by missing (or non-visible) dots. A non-visible dot is any dot that should have been printed, but was not. A nozzle might fail to print a dot because it is clogged or perhaps because it has become permanently nonoperative. Viscous ink plugs partially or totally obstructing a nozzle of a printhead also can dramatically affect the print quality by hindering or preventing the proper ejection of ink drops. To overcome this problem, ink-jet printers have been equipped with a spittoon (or service station) outside the print zone. Typically, an ink-jet printer ejects ink drops into the spittoon to clear viscous plugs from the nozzle.

If non-visible dots are detected, the printing system may be directed to service the printhead to clear any clogs. If, after servicing the printhead, it is determined that the same identified nozzles are failing to print dots, then either an out-of-ink condition exists or the identified nozzles have permanently failed. If it is determined that a group of nozzles connected to a single-colored ink reservoir have failed simultaneously, an out-of-ink condition is indicated so that the user can refill or replace the ink reservoir for that color. Otherwise, the identified nozzles that are failing to print dots are deactivated and previously dormant nozzles are activated to replace the deactivated nozzles. Rather than activating dormant nozzles to replace the deactivated nozzles, other active nozzles may be used to replace the deactivated nozzles. Thus, some active nozzles will be performing the work of two nozzles. Those who are skilled in the art will appreciate that this technique may be incorporated into existing shingling printing methods.

Yet another potential problem relates to the size of actual dots, which may be either too small or too large. The dots may be too small because low-volume ink drops were used to print them or the print medium does not absorb the ink well. The actual dots may be too large because high-volume ink drops were used to print them, or because the print medium absorbs the ink very well. Stored in the memory (RAM or ROM) of the printer (or perhaps in the memory of the computer) are a predefined minimum acceptable dot diameter and a predefined maximum acceptable dot diameter. These diameters may be set values (or ranges of values), or may be characteristic of corresponding virtual dots as derived from image data.

In a typical 600 dots per inch (DPI) ink-jet printer, the minimum acceptable dot diameter would be approximately 0.8 to 1.3 mils. Correspondingly, the maximum acceptable dot diameter would be approximately 1.9 to 2.4 mils.

If the diameter of a printed dot is less than the minimum acceptable dot diameter, then it is considered to be too small. Thus, corrective action should be taken to ensure that new dots printed by the associated nozzles will be approximately equal to or greater than the minimum acceptable dot diameter. Such corrective action may involve printing multiple dots at or near the same location, or increasing the ink-drop volume. Either action may be accomplished by modifying the image data in accordance with the identified solution.

If the diameter of a printed dot is greater than the maximum acceptable dot diameter, then it is considered to be too large. Thus, corrective action should be taken to ensure that new dots printed by the associated nozzles will be approximately equal to or less than the maximum acceptable dot diameter. This corrective action will involve decreasing the ink-drop volume, as by modifying the image data.

Measuring the diameter of a printed dot enables a precise energy calibration for each nozzle. In other words, an embodiment using the invention can determine the precise amount of energy necessary to fire a drop from each nozzle so that all dots have a uniform dot diameter without using excess energy which can produce early printhead failure or excessive heat buildup.

Adjusting the dot size of the dots surrounding a missing dot, small dot, or large dot is another form of corrective action can be taken to improve the print quality. If a dot is missing or small, the printhead may be directed to print the surrounding or adjacent dots larger. If the dot is large, the printhead may be directed to print the surrounding or adjacent dots smaller.

Individual and separate dots of an image may be printed in any blank space on a page so that the dot does not have a coextensive adjacent neighbor. Printing dots in this manner allows for easy measurement of a dot's characteristics (such as location and size). Furthermore, it allows for transparent "hidden dot" testing. Rather than printing a test pattern to determine and correct the printing of the printer, "hidden dots" may be interspersed about in the blank space on a page. These dots are inconspicuously printed on a page and then tested. Automatic correction then may take place without the user being aware of it.

Figure 4A:
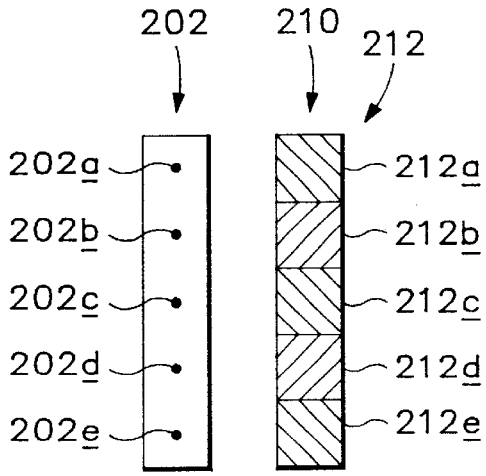
FIG. 4A is a schematic representation of a printhead having five nozzles and an actual image consisting of five dots, which are illustrated as square blocks.

FIG. 4A includes a schematic block representation of a printhead 202 with five nozzles 202*a*–202*e*. Also, shown in FIG. 4A, is an error-free actual image 212 which is identical to a virtual image 210. The actual image includes five dots 212*a*–212*e* which are illustrated as hatched square blocks. Each dot is associated with a nozzle on printhead 202. For example, actual dot 212*a* was printed by nozzle 202*a* actual dot 212*b* was printed by nozzle 202*b*, etc. In addition, each actual dot has a corresponding virtual dot which, in FIG. 4A, coincides with the location of the actual dot. The virtual dots represent the desired locations of the actual dots, and typically are stored as a virtual image in memory.

Figure 4B:
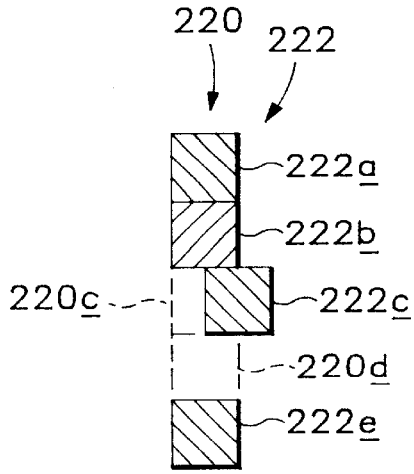
FIGS. 4B—4D are schematic representations of actual images that include dots exhibiting poor print-quality characteristics.

FIG. 4B illustrates an example of an actual image 222 which includes a set of actual dots which exhibit poor print-quality characteristics. Specifically, the poor-print-quality set of dots includes a misaligned dot 222*c* and a missing dot which is not shown. FIG. 4B thus shows an actual image 222 with corresponding good-print-quality actual dots 222*a*, 222*b* and 222*e* which printed correctly. A virtual image 220 indicates the desired locations of the actual dots. The boundaries of virtual dots 220*c* and 220*d* are the desired boundaries for actual dot 222*c* and the missing dot, respectively. Actual dot 222*c*, however, is printed outside the boundary of its corresponding virtual dot (it is misaligned relative to dots 222*a*, 222*b* and 222*e*, and relative to its corresponding virtual dot). There is no actual dot corresponding to virtual dot 220*d*. In FIG. 4B, misaligned actual dot 222*c* and the missing actual dot form a poor-print-quality set of dots of actual image 222.

Figure 4C:
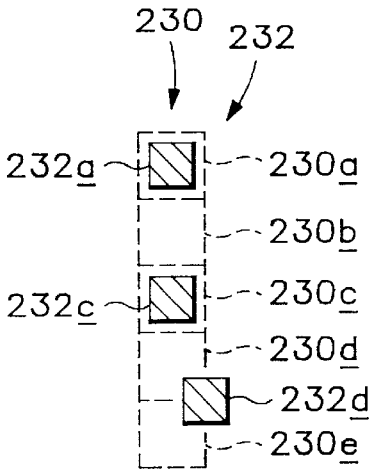

FIG. 4C illustrates another example of an actual image 232 which includes dots of poor print quality. Specifically, actual image 232 includes a poor print quality set of dots made up of all of its actual dots 232*a*, 232*c*, and 232*d*. Although all of the printed visible dots of FIG. 4C are uniform in size, each is less then the desired dot diameter, as illustrated by the boundaries of corresponding virtual dots 230*a*–230*e*. Additionally, dot 232*d* is not printed within the boundary of the corresponding virtual image 230 and thus is misaligned relative to dots 232*a*, and 232*c* and relative to its corresponding virtual dot 230*d*. Two of the actual dots are not shown at all because their associated nozzles failed to print them. Thus, corrective action should be taken to ensure that the nozzles associated with dots 232*a*, 232*b* and 232*c* apply more ink when printing subsequent actual dots. Corrective action also should be taken to ensure that the nozzle associated with dot 232*d* prints it at the appropriate location on the medium. Finally, action should be taken (e.g., printhead servicing) to ensure that the nozzles associated with the missing dots fire.

Figure 4D:
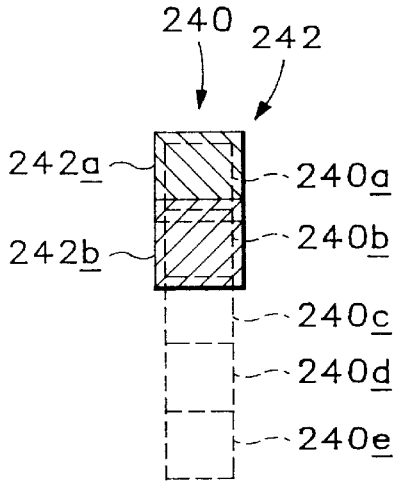

FIG. 4D illustrates still another example of an actual image 242 which includes a poor-print-quality set. A virtual image 240 with corresponding virtual dots 240*a*–240*e* also is shown. It will be noted that several of the dots are not shown because their associated nozzles failed to fire. Additionally, dots 242*a* and 242*b* are too large, exceeding the boundaries of their corresponding virtual dots 240*a* and 240*b*. Although the dots are uniform in size, each is greater than the desired dot diameters. FIG. 4D also illustrates another misalignment problem. Assume that nozzles 202*a* and 202*b* print different colored dots for which the combination of the two colored dots at one coextensive location on the print medium produces a blended color. Further assume that both actual dots 242*a* and 242*b* were intended to be printed within the boundary of virtual dot 240*a* to form the blended color. Based upon this blended color dot scenario, actual dot 242*b* is misaligned. Corrective action can be taken so that dot 242*b* is printed at the same location as dot 242*a* (e.g., the location of corresponding virtual dot 240*a*). Even when the colored dots are aligned, the resulting blended color may not match the desired color. Accordingly, corrective action may be taken to adjust ink used to print each dot so that the resulting blended color matches the desired color.

Figure 5:
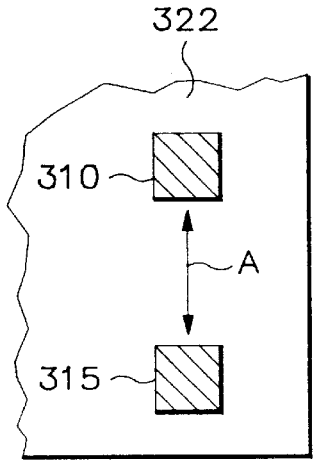
FIG. 5 is a schematic representation of two dots printed a distance A apart on a print medium.

In existing printers, a page is advanced though the print zone by a stepper motor. The distance that a page is advanced is based upon a defined, stored step distance of each step of the stepper motor. However, variations in the media, environmental conditions and mechanical tolerances cause slight differences between the defined, stored step distance of each step and the actual, measured distance of each step. FIG. 5 illustrates a fragmentary page 322 with two dots 310 and 315 printed thereon at a distance A apart from each other. It is possible to calculate the actual step distance that a page is advanced each step of the motor. To do this, the following may be done: Dot 310 is printed on page 322 and the stepper motor (not shown) advances the page one or more steps. The printer prints dot 315. Each dot is viewed by the optical device and their distance apart from each other is calculated by the controller. If the defined step distance of each step deviates from the measured distance of each step, then the defined step distance is replaced with measured step distance. In other words, image signals may be modified to compensate for the difference between the defined step distance and the measured step distance.

Figure 6A:
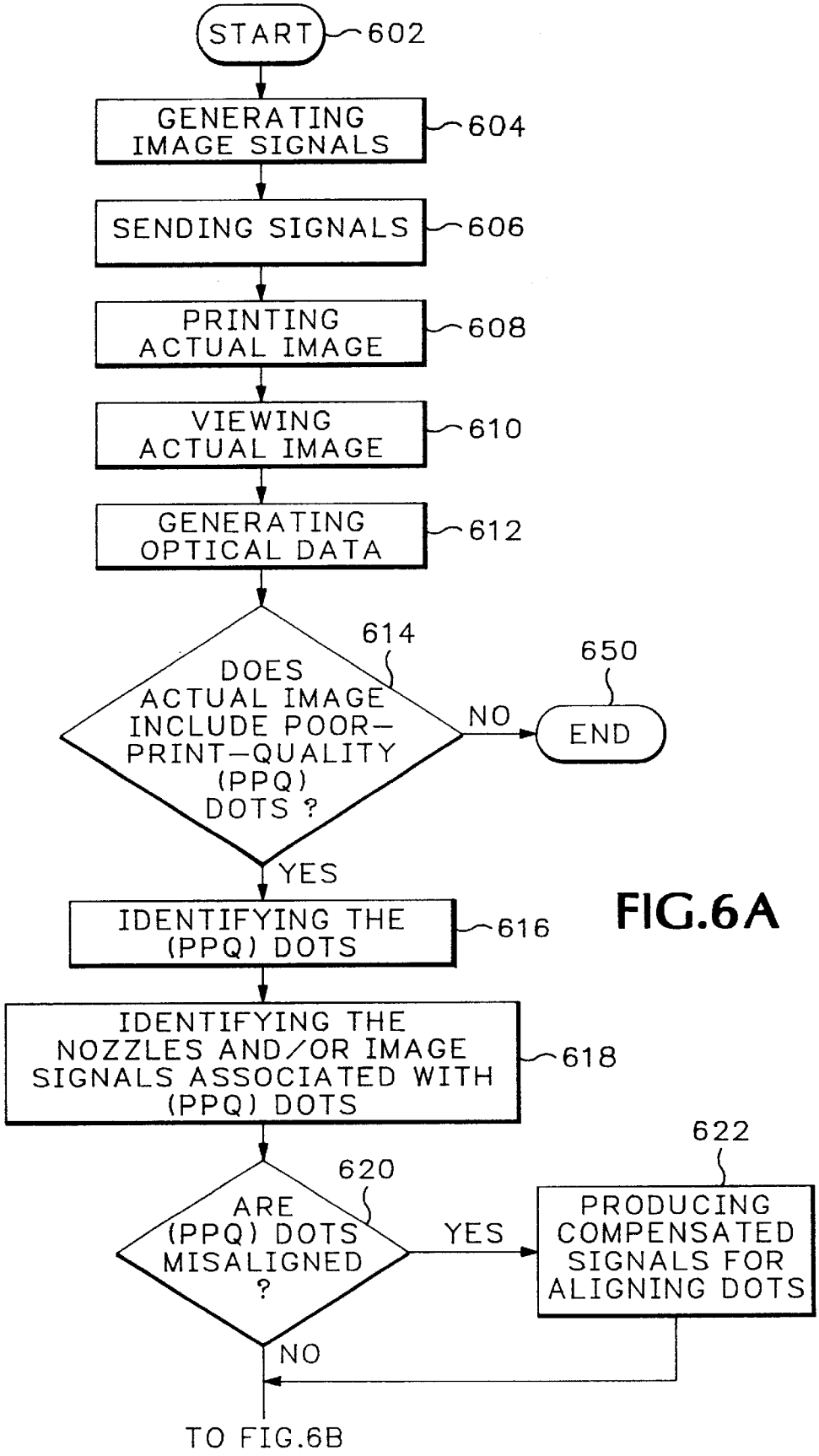
FIGS. 6A and 6B show a flowchart of a print-quality control method performed according to a preferred embodiment of the present invention.
Figure 6B:
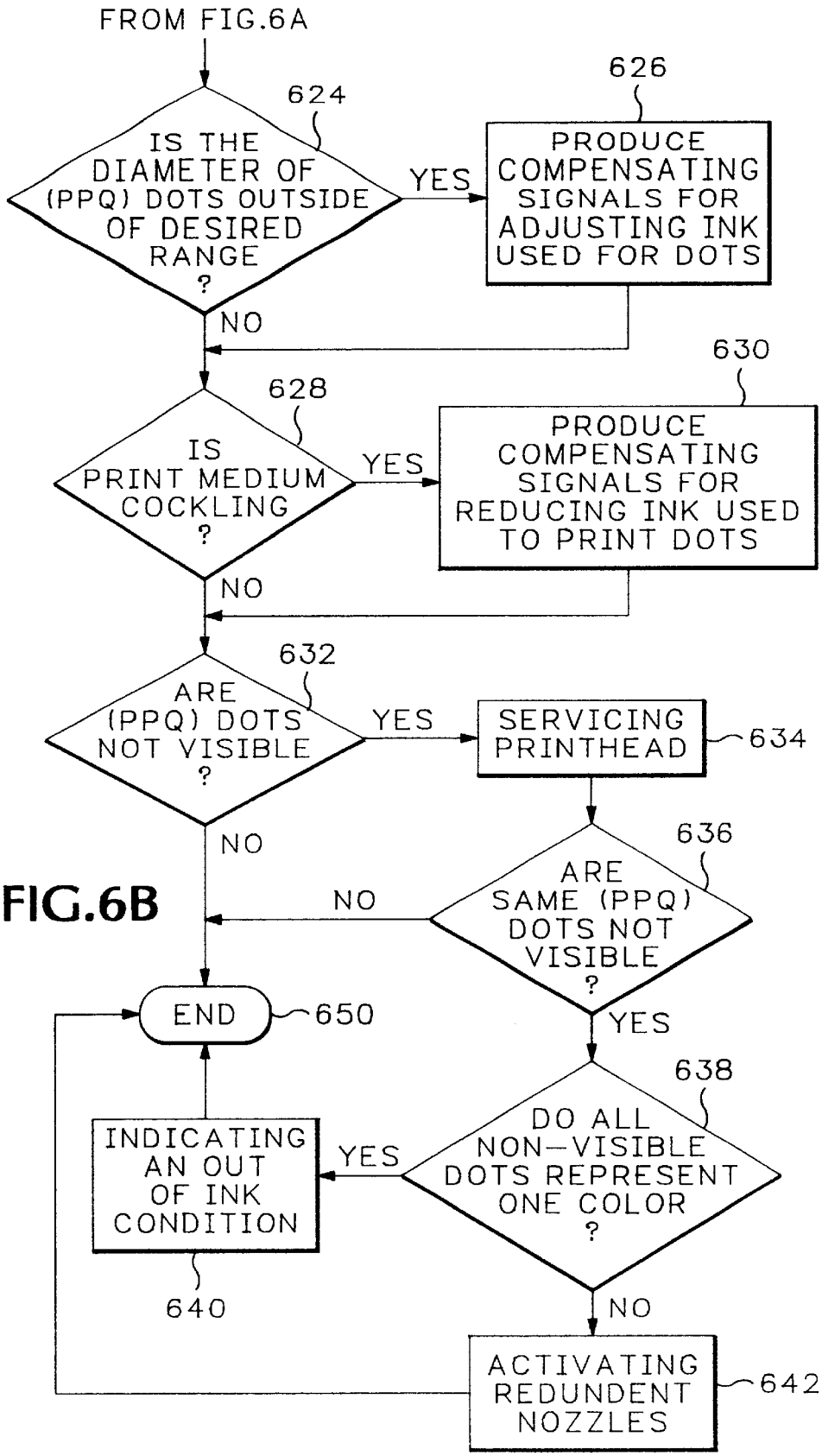

FIGS. 6A and 6B illustrate a preferred embodiment of the invented method via a flowchart. A process of controlling print quality according to the invention uses an ink-jet printer. That printer has a printing system that includes a printhead having plural nozzles and the system receives image signals directing the system to print an image.

The process begins at 602 of FIG. 6A. At 604, image signals (i.e., print image data) are generated. It may be generated by a controller, which may be a microprocessor in the printer or it may be an external host computer. Based upon these generated signals, a virtual image is defined and stored in memory. At 606, these signals are sent to the printing system, and at 608, the printing system prints an actual image on a print medium by firing the nozzles of the printhead according to signals received by the printing system. As discussed above, an actual image includes individual dots printed by the nozzles and the actual image may include a set of dots that represents poor print quality.

At 610, the optical device views (i.e., reads) the dots of the actual image, and at 612, corresponding optical data is generated. Based upon this generated data, the actual image may be recorded in memory in a manner similar to the virtual image. Next, at 614, the controller compares the actual image to the virtual image to identify a printhead error pattern. The controller also may analyze the generated data alone to decide whether the actual image includes such a printhead error pattern. If the image does not include a poor-print-quality (PPQ) set of dots, then no action is necessary and the process continues to an END at 650. Otherwise, a set of dots exists and the process proceeds to block 616, where the poor-print-quality set is identified. At 618, the nozzle or nozzles that printed the poor-print-quality set of dots are identified.

Thereafter, signal modification data which may be used to modify image signals is determined in order to compensate for the poor print quality of the set of dots printed by the identified. Typically, this involves modifying the signals which operate the nozzles so that subsequent dots printed by the identified nozzles will not be of poor print quality. Such compensation may be described as modifying subsequent image data to compensate for the identified error pattern.

At 620, the controller determines if dots of the poor-print-quality (PPQ) set are misaligned relative to other dots of the actual image or relative to corresponding dots of the virtual image. If so, then at 622 the controller modifies the image signals which are associated with the identified nozzles to compensate for such misalignment so that any subsequent dots printed by the identified nozzles are aligned. If no dots are misaligned or when the step at block 622 is complete, the process proceeds to block 624 (FIG. 6B).

In FIG. 6B at 624, the controller determines if dots of the poor-print-quality set have a diameter outside of a predetermined desired range. Small dots are dots which have a diameter that is less than a predefined minimum acceptable dot diameter. Large dots are dots which have a diameter that is greater than a predefined maximum acceptable dot diameter. If the dot is outside the desired range, then at 626, the controller calculates signal modification data which may be used to modify image signal, associated with the identified nozzles. Such modified image signals are intended to direct the identified nozzles to use more or less ink to print any subsequent dots from the identified nozzles so that the diameter of subsequent dots is within the desired range.

In general with regard to blocks 624 and 626, the controller determines whether any of the actual dots have a diameter that deviates from a diameter of corresponding virtual dots. If so, then the controller compensates for any of the actual dots having a diameter that deviates from a diameter of corresponding virtual dots so that subsequent actual dots have a diameter approximately equal to corresponding virtual dots. Alternatively, the controller compensates for actual dots having a deviating diameter by identifying the nozzles printing such actual dots and adjusting the diameter of subsequent actual dots that would be adjacent subsequent actual dots printed by the identified nozzles.

Next, the process goes to block 628 where the controller determines if a portion of the print medium, which is found where the poor-print-quality set was printed, is cockling. If it is cockling, then at 630 the controller adjusts signals to direct the identified nozzles to use less ink to print any new dots from the identified nozzles so that subsequently printed on portions of the print medium do not cockle.

Next at 632, the controller determines if dots of the poor-print-quality set are visible. If dots are not visible, then at 634, the controller directs the print system to service the printhead so that clogs in the identified nozzles may be cleared. After servicing at 636, dots printed from those identified nozzles are tested again. If they still are not visible, then at 638, the controller determines if each nozzle in a group of the identified nozzles are operatively connected to a single-color ink reservoir. If so, then at 640 an indication is provided regarding the ink reservoir being empty. From 640, the process proceeds to END at 650. If each nozzle in the group of the identified nozzles are not operatively connected to a single-color ink reservoir, then after 638 the process proceeds to block 642. At 642, the controller activates at least one dormant nozzle to replace at least one of the identified nozzles. The process then ends at 650.

In another embodiment of the present invention, the diameter of a printed dot is measured and the controller determines whether its diameter exceeds a predefined maximum incompatibility diameter (which is larger than the maximum acceptable diameter). If it does, then the user is notified that the print medium is incompatible with the ink-jet printer. For example, if a medium with the absorptive characteristics of tissue or paper towels is fed into the printer, the print quality would be extremely poor because the periphery of each dot will be large and fuzzy.

Industrial Applicability

Accordingly, it may be seen that the invented print-quality control system and method provide a significant advancement in improving overall print quality in an automatic manner that is transparent to the user.

While the present invention has been shown and described with reference to the foregoing preferred embodiment, it will be apparent to those skilled in the art that changes in form and detail may be made therein without departing from the spirit and scope of the invention as defined in the appended claims.

We claim:

1. A print-quality control method for use in connection with a printer having a printhead with plural nozzles configured to print on a print medium based on image data, wherein the plural nozzles include active nozzles that are actively used to print dots on a print medium, the method comprising the steps of:

defining a virtual image derived from the image data, wherein the virtual image includes a plurality of virtual dots and an actual image includes a plurality of actual dots;

printing the actual image on the print medium based on the image data;

comparing the actual dots of the actual image to the virtual dots of the virtual image to identify a printhead error pattern of poor print quality dots;

identifying at least one defective nozzle producing one or more poor print quality dots of the printhead error pattern; and modifying subsequent image data to compensate for the identified printhead error pattern by directing at least one active nozzle to substitute for at least one defective nozzle.

2. An automatic print-quality control system for use in connection with printer having a printhead with plural nozzles configured to print one or more actual dots on a print medium based on image data, wherein the plural nozzles include active nozzles that are actively used to print dots on a print medium, the system comprising:

a controller including memory for storing one or more virtual dots derived from the image data and corresponding to the actual dots; and an optical device including an emitter configured to emit electromagnetic waves onto a print medium and a detector configured to detect electromagnetic waves reflected from the print medium to view actual dots printed on the print medium, to produce optical data therefrom, and to send the optical data to said controller;

said controller being configured to compare actual dots to corresponding virtual dots to identify a printhead error pattern indicating poor print quality dots, to identify at least one defective nozzle producing one or more poor print quality dots of the printhead error pattern, and to modify subsequent image data to compensate for the identified printhead error pattern by directing at least one active nozzle to substitute for at least one defective nozzle.

* * * * *